United States Patent [19]

Hennecke et al.

[11] 4,161,295

[45] Jul. 17, 1979

[54] BLOWER BEATER MILL

[75] Inventors: Hermann Hennecke; Paul Mertens, both of Mülheim; Josef Krecher, Dorsten, all of Fed. Rep. of Germany

[73] Assignee: Deutsche Babcock Aktiengesellschaft, Oberhausen, Fed. Rep. of Germany

[21] Appl. No.: 860,763

[22] Filed: Dec. 15, 1977

[30] Foreign Application Priority Data

Dec. 23, 1976 [DE] Fed. Rep. of Germany ..... 2658467

[51] Int. Cl.[2] ..... B02C 13/10

[52] U.S. Cl. ..... 241/66; 241/67; 241/188 R; 241/191

[58] Field of Search ..... 241/56, 66, 67, 188 R, 241/189 R, 189 A, 191, 194

[56] References Cited

U.S. PATENT DOCUMENTS

| | | | |
|---|---|---|---|
| 551,097 | 12/1895 | Russell | 241/188 R X |
| 2,087,492 | 7/1937 | Williams | 241/188 R X |
| 3,471,093 | 10/1969 | Wienert | 241/194 X |
| 3,880,366 | 4/1975 | Loevenich | 241/194 |
| 3,993,254 | 11/1976 | Bicik et al. | 241/67 |

FOREIGN PATENT DOCUMENTS

| | | | |
|---|---|---|---|
| 2605751 | 9/1976 | Fed. Rep. of Germany | 241/194 |

*Primary Examiner*—Howard N. Goldberg
*Attorney, Agent, or Firm*—Max Fogiel

[57] ABSTRACT

A blower beater mill in which a rotor has a beater portion provided with beater arms in the form of two interconnected parts. Beater arm bases are fastened in hub rings of the shaft of the rotor, and fastening elements of two beater arm portions are located above shaft crests of the hub rings. Cover elements are located axially with the rotor in a free space between the beater arm bases, and these cover elements are located on a diameter between the shaft crests of the hub rings and the fastening elements of the beater arm portions. Openings pass through the beater arm bases between the cover elements and the shaft crests of the hub rings in the axial direction of the rotor. An opening in one beater arm base is aligned with the opening in the corresponding beater arm base of the following beater arm rows. The cover elements have an outside jacket which surrounds the shaft crests of the hub rings at a distance. The jacket has cutouts for accommodating the beater arm bases. The cover elements, furthermore, are connected to the beater arm bases, and they are tip-stretched as lateral connecting pieces to the beater arm bases. The narrower side walls of the centered beater arm bases face the side walls of adjacent beater arm bases of the same beater arm row, at a slight distance.

10 Claims, 4 Drawing Figures

BLOWER BEATER MILL

BACKGROUND OF THE INVENTION

The present invention relates to a blower beater mill whose rotor has a beater portion with beater arms. Two connected parts with the beater arm bases are fastened in the hub rings of the shaft and the fastening elements of the two beater arm portions are provided above the shaft crests of the hub rings. Such mills suck in hot flue gases to dry the moist material to be ground through a suction shaft from the firebox (or combustion chamber) of the boiler. Thus, the rotor is subject to a high temperature load during the grind-dry process or during the start and stopping of the mill.

The present invention aims to protect the rotor against temperature load. This shall not interfere with replacement of the beater arms of the blower beater mill.

There is already known a beater mill (German Laid-Open Document No. 1,216,076) where individual beater arms are interchangeably fastened to the rotor and where intermediate pieces are used which are fastened to the hub rings. Every beater arm is held between an intermediate piece pair and fastened by means of a bolt located above the hub rings. Also, a slot provided in the lower face surface of the beater arm engages a bolt located between the hub rings. Because of this swinging suspension of the beater arms, vibrations of the beater arm system manifest themselves in an unfavorable manner.

Accordingly, it is the object of the present invention to protect the mill shaft of a blower beater mill of the above type in such a way that high temperatures at the shaft crest are avoided, and the temperature difference across the shaft cross-section is reduced, and also so that the beater arms can be replaced individually.

Another object of the present invention is to provide a blower beater mill of the foregoing character in which the arrangement is substantially simple in construction and may be economically fabricated.

A further object of the present invention is to provide a beater mill arrangement, as described, which may be readily maintained in service and which has a substantially long operating life.

SUMMARY OF THE INVENTION

The objects of the present invention are achieved by providing cover elements located axially with the rotor in the free space between the beater arm bases; these cover elements are located on a diameter between the shaft crests of the hub rings and the fastening elements of the beater arm portions. These cover elements prevent the hot flue gases passing through the blower beater mill from penetrating into the passages between the hub rings and from directly heating the shaft body at its surface. At the same time, the space between the cover elements and the hub rings constitutes a heat insulation. The heat insulating effect can be intensified by filling the intervening space with insulating material, as for example, asbestos. Also, the cover elements can be joined in such a way that a cooling gas is blown through the tunnel-shaped space, carrying off heat and reducing the heating of the shaft. By dividing the beater arms and the location of the fastening elements between the two beater arm portions outside the hub rings and outside the cover elements, any of the beater arms located offset in adjacent rows can be removed and replaced without requiring a complete disassembly starting with the shaft end.

The cover elements may comprise a jacket which encloses the hub rings at a distance, and has a cutout for admitting the beater arms. The jacket provides for covering the hub rings and the gap between the beater arm bases.

To form a continuous space for the flow of the cooling gas, in an advantageous embodiment of the invention, an opening is located through the beater arm bases in the axial direction of the rotor between the cover elements and the shaft crests of the hub rings. The opening in one beater arm base is aligned with the opening in the corresponding beater arm base of the other beater arm rows.

The cover elements may also be connected to the beater arm base by tip-stretching. In this case, covering is done by the beater arm bases themselves so that during assembly of the rotor, the number of individual parts is not increased.

Also, a solid insulating material may be provided between the facing surfaces of shaft and beater arm base. The associated tolerances must be considered when designing the beater arm base. In another advantageous embodiment, the beater arm base portion projecting from the hub rings is fork-shaped, with the beater arm engaging this and being fastened to it. This embodiment is simple and permits easy replacement of individual beater arms.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
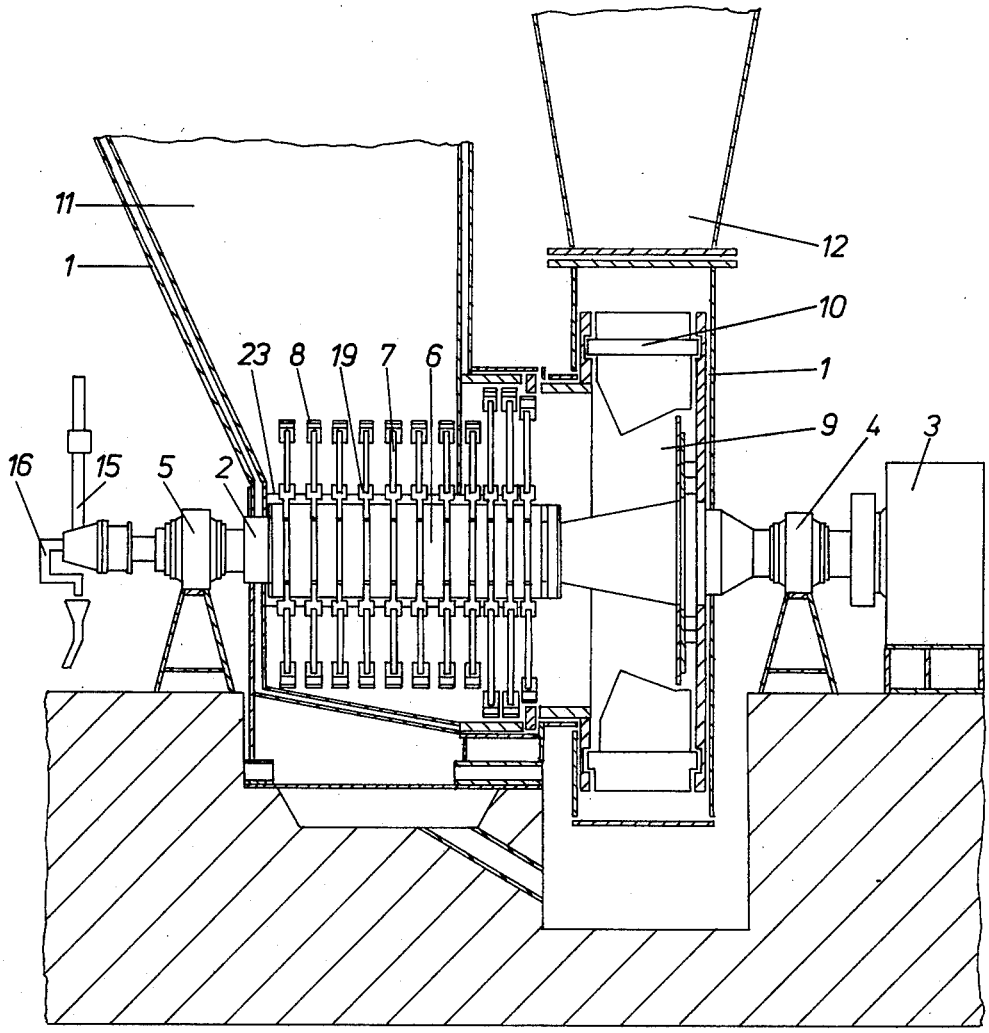
FIG. 1 shows a lengthwise section through a blower beater mill.

The blower beater mill comprises a rotor located in a mill housing. The rotor comprises the mill shaft 2 which is driven by a motor 3 via a transmission, and is located in two bearings 4 and 5 outside the mill housing 1. The mill shaft 2 mounts a beater portion 6 with several rows of beater arms 7, as well as attached beater heads 8 and a bucket wheel (or fan impeller) 9 with radial buckets (or blades) 10.

The bucket wheel (or fan impeller) 9, acting as a fan, aspirates hot flue gases from the firebox (or combustion chamber) of a boiler (not shown). The material to be ground, in the present case crude lignite, together with the hot flue gases enters the mill via the mill intake 11. The ground material is delivered to the burners (not shown) of the boiler via a transition portion 12 and the dust line.

In the example shown, the beater portion 6 extends up to the region of the mill intake 11. However, the invention can also be used for those blower beater mills where the mill shaft is not provided with beaters in the mill intake region.

The mill shaft 2 is internally water cooled and has a center bore 13 through which a pipe 14 of smaller diameter passes. The pipe is connected to the cooling water intake 15, located outside the mill housing 1, and the ring channel between the pipe 14 and the wall of the bore 13 are connected to the cooling water return 16.

Grooves 17 are lathe-turned into the shaft body of the mill shaft 2, to form hub rings 18. The beater arm bases 19 are inserted into the grooves 17 between the hub rings 18. Each beater arm base 19 is held in the mill shaft 2 by means of hub bolts 20 which are guided in lined-up bores in the hub rings 18 and in beater arm bases 19.

The beater arm base 19 and the actual beater arm 7 are two separate parts which are connected by beater arm bolts 21 above the hub rings 18. For this purpose, the portion of the beater arm base 19 projecting from the hub rings 18 has the form of a fork. The lower part of the beater arm 7 extends between the fork tines 22 and is fastened by two beater arm bolts 21 which pass through bores in the fork tines 22 of the beater arm bases 19 and in the beater arms 7.

Figure 2:
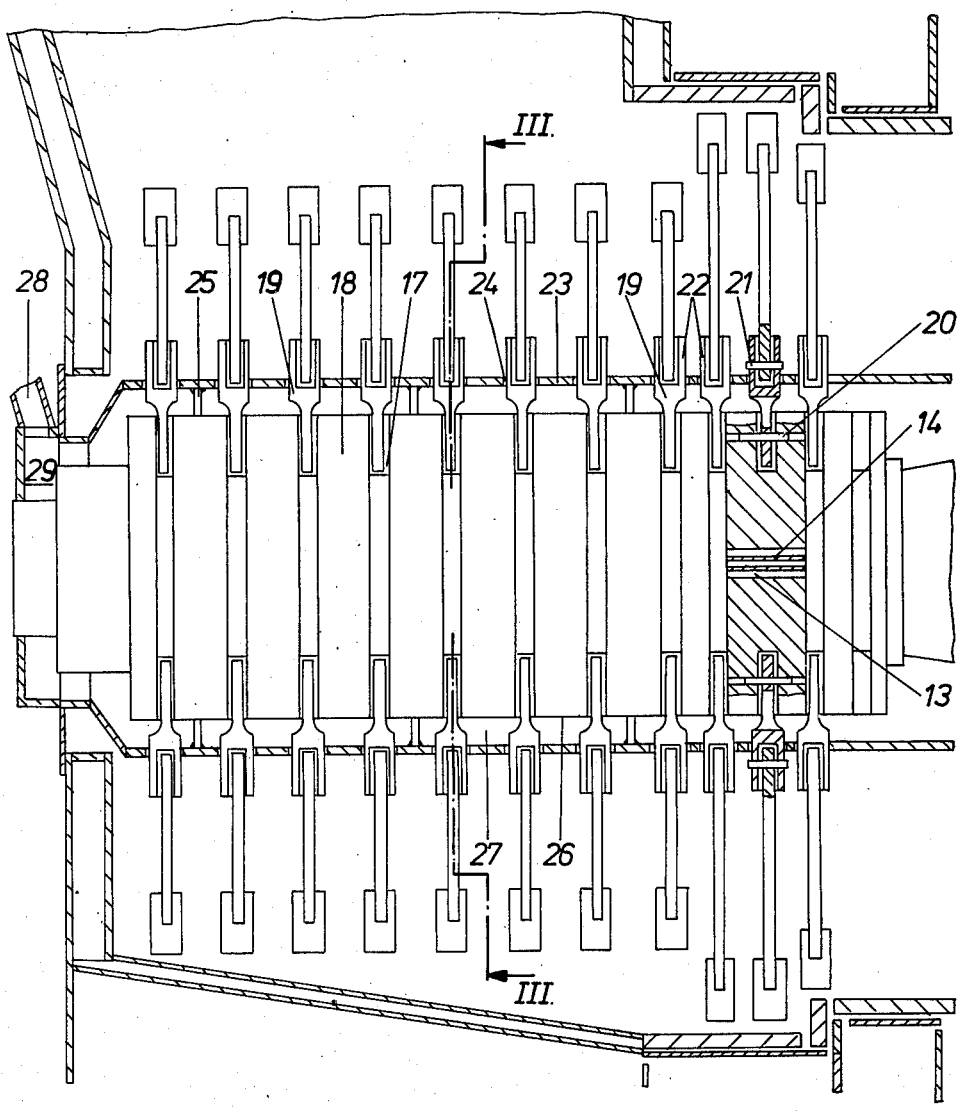
FIG. 2 shows a lengthwise section through a beater portion.
Figure 3:
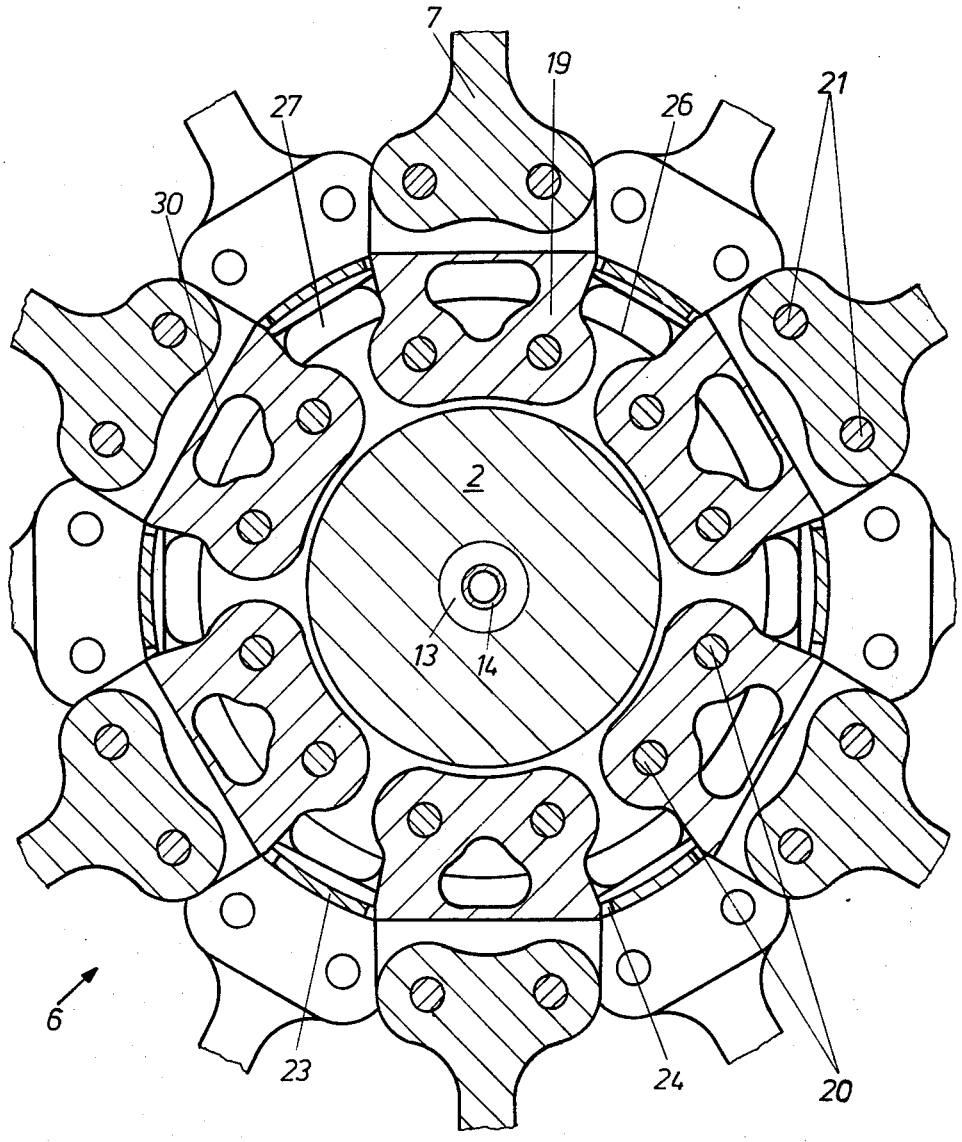
FIG. 3 shows a section taken along line III—III of FIG. 2.

To protect the rotor against the hot gases passing through the blower mill, the shaft body of the beater part 6 is surrounded at a distance by cover elements. With the embodiment shown in FIGS. 2 and 3, the cover elements are formed by an outside jacket 23. This comprises two half shells placed about the shaft body; these half shells are connected at their juncture by screw fasteners. The outside jacket 23 has cutouts 24 through which beater arm bases 19 are inserted. Pins 25 which are welded to the outside jacket 23 maintain the spacing between the outside jacket 23 and the shaft crests 26 of the hub rings.

The beater arms 7 are located in staggered fashion in adjacent rows. In order to replace the beater arms 7, the diameter of the outside jacket 23 is smaller than the hole diameter of the beater arm bolts 21 used as fasteners.

In the space 27 between the shaft crests 26 and the outside jacket 23 is quiescent air which protects the shaft crests 26 against high temperature load from the flue gases. To increase the insulation effect, the space 27 may also be filled with a heat-resistant insulating material such as asbestos.

Through the tunnel-shaped space 27, a cooling gas, e.g. air or cold flue gas, may be blown. The cooling gas is passed through a stub 28 in the mill housing 1 into an annular chamber 29 and from there reaches the space 27. To permit unhindered passage through the space 27 for the cooling gas, openings 30 are located through the beater arm base 19 underneath the cover elements; these openings run in the axial direction of the rotor or of the mill shaft 2. With the embodiment shown in FIGS. 2 and 3, the openings 30 of corresponding beater arm bases 19 of the second-next beater arm rows are lined up with each other. In this manner a through-going channel appears within the tunnel-shaped space 27. This channel is formed by the opening 30 in a beater arm base 19 of the first beater arm row, the space 27 between two beater arm bases 19 of the second beater arm row, and the opening 30 in the beater arm base 19 of the third beater arm row, etc.

Figure 4:
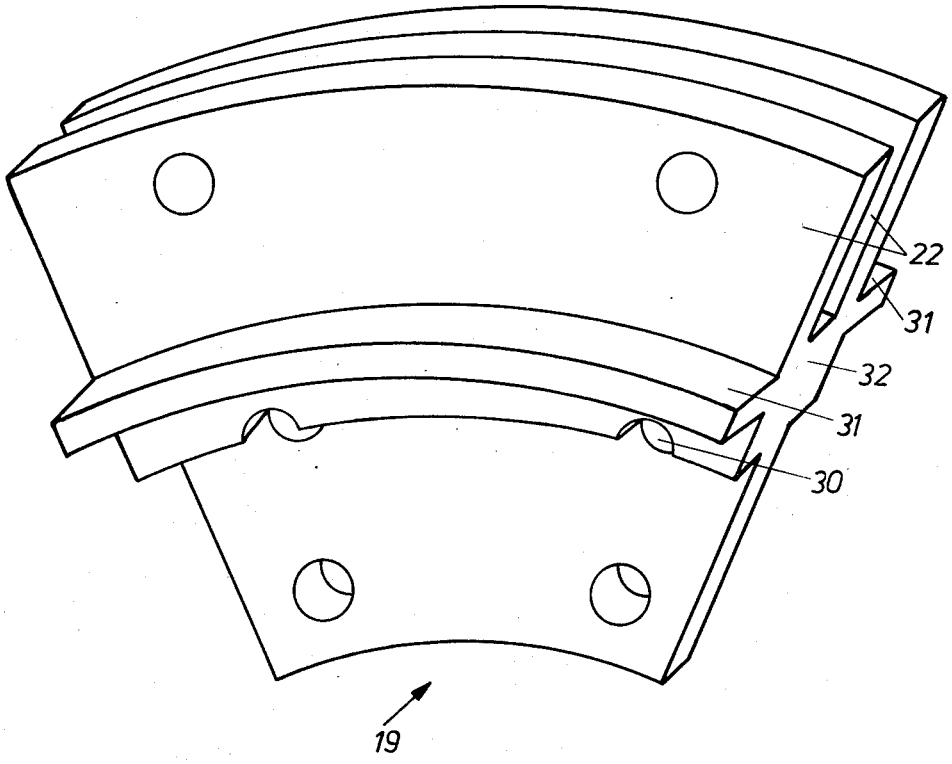
FIG. 4 shows another embodiment of the beater arm base.

With the embodiment, shown in FIG. 4, of a beater arm base, an outside jacket has been left out. The task of the cover elements is assumed by connecting pieces 31 which are connected to the beater arm bases 19. In the case shown, the connecting pieces 31 are tip-stretched on both sides of the beater arm base 19. The connecting pieces of each beater arm base 19 face the corresponding connecting pieces 31 of the beater arm bases 19 of the adjacent and of the same beater arm row at a small distance or touch them. When the connecting pieces 31 are sufficiently wide, it may be sufficient to locate them on only one side of the beater arm base 19. The beater arm bolts 21 for fastening the beater arm 7 to the beater base 19 are located on a larger diameter than the connecting pieces 31 so that an interchange of individual beater arms 7 is possible.

The centrally located beater arm bases 19 are made so that a maximum gap of 2 mm width results between the beater arm bases 19 adjacent to narrower side walls 32. In the embodiment shown in FIG. 4, the surfaces of the beater arm base 19 which face associated surfaces of the mill shaft may be provided with a solid insulating material. The tolerances necessary for placing the insulating material should be considered in the dimensioning of the beater arm base 19.

The tunnel-shaped space 27 to conduct the cooling gas is formed by the openings 30 which pass through the beater arm base 19 underneath connecting pieces 31. According to FIG. 4, two openings 30 are provided with spacing corresponding to the spacing of the hub bolts 20.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

We claim:

1. A blower mill, comprising: a rotor with a beater portion having beater arms comprising three interconnected parts; one of said three parts comprising an intermediate portion having at one end thereof a beater arm base connected thereto; a beater head connected to another opposite end of said intermediate portion; a shaft with hub rings; said hub rings having peripheral surfaces; two of said interconnected parts of said beater arms having fastening elements above said peripheral surfaces of the hub rings; cover elements located axially with said rotor in a free space between beater arm bases and radially at a distance above said peripheral surfaces of said hub ring; said cover elements being located on a diameter between said peripheral surfaces of said hub rings and said fastening elements of the beater arm parts; said three parts comprising said intermediate portion, beater arm base and beater head with connections of said three parts being above said cover elements.

2. A blower beater mill as defined in claim 1, wherein at least one opening passes through the beater arm bases between said cover elements and said peripheral surfaces of said hub rings in an axial direction of said rotor, an opening in one beater arm base being aligned with an opening in the corresponding beater arm base of a following beater arm row.

3. A blower beater mill as defined in claim 1, wherein said cover elements comprise an outside jacket surrounding said peripheral surfaces of said hub rings at a spaced distance, said jacket having cutouts for accommodating said beater arm bases.

4. A blower beater mill as defined in claim 1, wherein said cover elements are connected to said beater arm bases.

5. A blower beater mill as defined in claim 4 wherein said cover elements are tip-stretched as lateral extension members to said beater arm bases.

6. A blower beater mill as defined in claim 1 wherein said beater arm bases are centered and have narrow side walls facing sidewalls of adjacent beater arm bases of the same beater arm row at a substantially small distance.

7. A blower beater mill as defined in claim 1, wherein said beater arm bases project from said hub rings and are fork-shaped, the beater arm reaching between fork tines of said fork-shaped member and being fastened between said tines.

8. A blower beater mill as defined in claim 1, including a solid insulating material located between facing areas of said shaft and beater arm bases.

9. A blower beater mill as defined in claim 1 wherein said cover elements comprise substantially a closed jacket through which said beater arms extend.

10. A blower beater mill as defined in claim 1, wherein at least one opening passes through the beater arm bases between said cover elements and said peripheral surfaces of said hub rings in an axial direction of said rotor, an opening in one beater arm base being aligned with an opening in the corresponding beater arm base of a following beater arm row; said cover elements comprising substantially an outside jacket surrounding said peripheral surfaces of said hub rings at a spaced distance, said jackets having cutouts for accommodating said beater arm bases; said beater arm bases being centered and having narrow side walls facing side walls of adjacent beater arm bases of the same beater arm row at a substantially small distance, said beater arm bases projecting from said hub rings and being fork-shaped, the beater arm reaching between fork tines of said fork-shaped members and being fastened between said tines.

* * * * *